US009260949B2

(12) United States Patent
Brinkmann et al.

(10) Patent No.: US 9,260,949 B2
(45) Date of Patent: Feb. 16, 2016

(54) SUBSEA PRODUCTION SYSTEM HAVING ARCTIC PRODUCTION TOWER

(75) Inventors: Carl R. Brinkmann, Bellaire, TX (US); Dmitri G. Matskevitch, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 19 days.

(21) Appl. No.: 13/997,609

(22) PCT Filed: Dec. 20, 2011

(86) PCT No.: PCT/US2011/066155

§ 371 (c)(1),
(2), (4) Date: Jun. 24, 2013

(87) PCT Pub. No.: WO2012/102806

PCT Pub. Date: Aug. 2, 2012

(65) Prior Publication Data

US 2013/0292128 A1 Nov. 7, 2013

Related U.S. Application Data

(60) Provisional application No. 61/437,381, filed on Jan. 28, 2011.

(51) Int. Cl.
*E21B 43/01* (2006.01)
*E21B 43/013* (2006.01)
(Continued)

(52) U.S. Cl.
CPC ..... *E21B 43/013* (2013.01); *B63B 21/50* (2013.01); *E02D 23/02* (2013.01); *E21B 17/01* (2013.01); *E21B 43/01* (2013.01)

(58) Field of Classification Search
CPC . E02B 17/0017; E02B 17/0021; E02B 17/02; E02B 17/021; E02B 17/027
USPC ..... 405/195.1, 196, 203, 204, 211, 217, 405/220; 166/344, 352, 354
See application file for complete search history.

(56) References Cited

U.S. PATENT DOCUMENTS 3,366,173 A 1/1968 McIntosh
3,412,564 A 11/1968 McClintock
(Continued)

FOREIGN PATENT DOCUMENTS

JP 59061613 4/1984

OTHER PUBLICATIONS

PCT/US2011/066155—International Search Report and Written Opinion dated Apr. 13, 2012.

*Primary Examiner* — Matthew Buck
*Assistant Examiner* — Patrick Lambe
(74) *Attorney, Agent, or Firm* — ExxonMobil Upstream Research—Law Organization

(57) ABSTRACT

A subsea production system for conducting hydrocarbon recovery operations in a marine environment, including a trussed tower having a first end including a base residing proximate the seabed and a second end having a landing deck configured to receive and releasably attach to a floating drilling unit. The system also includes one or more hydrocarbon fluids storage cells. The storage cells reside at the seabed proximate the base of the trussed frame. The system further includes subsea production operational equipment that resides within the trussed frame near the water surface and is in fluid communication with the hydrocarbon fluids storage cells. A method for installing such components is also provided.

41 Claims, 10 Drawing Sheets

(51) Int. Cl.

| | |
|---|---|
| ***E02D 23/02*** | (2006.01) |
| ***B63B 21/50*** | (2006.01) |
| ***E21B 17/01*** | (2006.01) |

(56) References Cited

U.S. PATENT DOCUMENTS

| | | | | | |
|---|---|---|---|---|---|
| 3,525,388 | A | | 8/1970 | McClintock | |
| 3,525,392 | A | | 8/1970 | Lloyd et al. | |
| 3,535,884 | A | * | 10/1970 | Chaney | 405/210 |
| 3,550,385 | A | | 12/1970 | Lowd et al. | |
| 3,881,549 | A | * | 5/1975 | Thomas | 166/357 |
| 3,990,254 | A | | 11/1976 | Mo | |
| 4,177,690 | A | | 12/1979 | Klinkenberg | |
| 4,188,157 | A | * | 2/1980 | Vigander | 405/210 |
| 4,212,561 | A | | 7/1980 | Wipkink | |
| 4,314,776 | A | | 2/1982 | Palmer et al. | |
| 4,378,179 | A | | 3/1983 | Hasle | |
| 4,391,332 | A | | 7/1983 | Fayren | |
| 4,422,804 | A | | 12/1983 | Gerwick, Jr. et al. | |
| 4,511,287 | A | | 4/1985 | Horton | |
| 4,604,961 | A | | 8/1986 | Ortloff et al. | |
| 4,610,569 | A | * | 9/1986 | Finn et al. | 405/202 |
| 4,684,292 | A | | 8/1987 | Danguy des Deserts et al. | |
| 4,696,601 | A | | 9/1987 | Davenport | |
| 4,696,603 | A | | 9/1987 | Danaczko et al. | |
| 4,696,604 | A | | 9/1987 | Finn et al. | |
| 4,717,288 | A | | 1/1988 | Finn et al. | |
| 4,721,417 | A | | 1/1988 | Piazza et al. | |
| 4,723,875 | A | | 2/1988 | Sutton | |
| 4,738,567 | A | | 4/1988 | McGillivray | |
| 4,740,109 | A | | 4/1988 | Horton | |
| 4,762,180 | A | | 8/1988 | Wybro et al. | |
| 4,781,497 | A | | 11/1988 | Karsan et al. | |
| 4,793,739 | A | | 12/1988 | Hasle et al. | |
| 4,810,135 | A | | 3/1989 | Davenport et al. | |
| 4,848,474 | A | | 7/1989 | Parizot et al. | |
| 5,195,848 | A | | 3/1993 | Huete et al. | |
| 5,199,821 | A | | 4/1993 | Huete et al. | |
| 5,207,534 | A | | 5/1993 | Brasted et al. | |
| 5,342,148 | A | | 8/1994 | Huete et al. | |
| 5,383,748 | A | | 1/1995 | Waddell | |
| 5,423,632 | A | | 6/1995 | Ekvall et al. | |
| 5,431,512 | A | | 7/1995 | Haney | |
| 5,439,060 | A | | 8/1995 | Huete et al. | |
| 5,439,324 | A | | 8/1995 | Ekvall et al. | |
| 5,447,392 | A | | 9/1995 | Marshall | |
| 5,480,265 | A | | 1/1996 | Marshall et al. | |
| 5,480,266 | A | | 1/1996 | Marshall et al. | |
| 5,486,070 | A | | 1/1996 | Huete | |
| 5,551,801 | A | * | 9/1996 | Gallaher et al. | 405/204 |
| 5,588,781 | A | | 12/1996 | Smolinski et al. | |
| 5,593,250 | A | | 1/1997 | Smith et al. | |
| 5,642,966 | A | | 7/1997 | Morrison et al. | |
| 5,651,640 | A | | 7/1997 | Huete et al. | |
| 5,657,823 | A | | 8/1997 | Kogure et al. | |
| 5,741,089 | A | | 4/1998 | Gallaher et al. | |
| 5,878,814 | A | | 3/1999 | Breivik et al. | |
| 5,899,639 | A | | 5/1999 | Simmons | |
| 5,941,746 | A | | 8/1999 | Isnard et al. | |
| 5,988,949 | A | | 11/1999 | Will | |
| 6,113,314 | A | | 9/2000 | Campbell | |
| 6,196,322 | B1 | | 3/2001 | Magnussen | |
| 6,564,873 | B1 | | 5/2003 | Tilbrook et al. | |
| 6,651,745 | B1 | | 11/2003 | Lush et al. | |
| 7,197,999 | B2 | | 4/2007 | Murray | |
| 7,377,225 | B2 | | 5/2008 | Finn et al. | |
| 2006/0054328 | A1 | | 3/2006 | Paulson et al. | |
| 2012/0266801 | A1 | | 10/2012 | Brinkmann et al. | |

* cited by examiner

SUBSEA PRODUCTION SYSTEM HAVING ARCTIC PRODUCTION TOWER

CROSS-REFERENCE TO RELATED APPLICATION

This application is the National Stage of International Application No. PCT/US2011/066155, filed 20 Dec. 2011, which claims the priority benefit of U.S. Provisional Patent Application 61/437,381 filed 28 Jan. 2011 entitled Subsea Production System Having Arctic Production Tower, the entireties of which are incorporated by reference herein.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present invention relates to the field of offshore drilling technology. More specifically, the present invention relates to a subsea production tower for use primarily in icy arctic waters.

DISCUSSION OF TECHNOLOGY

As the world's demand for fossil fuels increases, energy companies find themselves pursuing hydrocarbon resources located in more remote and hostile areas of the world, both onshore and offshore. Such areas include Arctic regions where ambient air temperatures reach well below the freezing point of water. Specific onshore examples include Canada, Greenland and northern Alaska. Offshore examples include the U.S. and Canadian Beaufort Seas.

One of the major problems encountered in offshore arctic regions is the continuous formation of sheets of ice on the water surface. Ice masses formed off of coastlines over water depths greater than 20 or 25 meters are dynamic in that they are almost constantly moving. The ice masses, or ice sheets, move in response to such environmental forces as wind, waves, and currents. Ice sheets may move laterally through the water at rates as high as about a meter/second. Such dynamic masses of ice can exert enormous forces on structural objects in their path.

A related danger encountered in arctic waters is pressure ridges of ice. These are large mounds of ice which usually form within ice sheets and which may consist of overlapping layers of sheet ice and re-frozen rubble caused by the collision of ice sheets. Pressure ridges can be up to 30 meters thick or more and can, therefore, exert proportionately greater forces than ordinary sheet ice.

Surface piercing, bottom supported stationary structures are particularly vulnerable in offshore arctic regions, especially in areas of deep water. The major force of an ice sheet or pressure ridge is directed near the surface of the water. If an offshore structure comprises a drilling platform or deck supported by a long, comparatively slender column which extends well below the surface to the sea bottom, the bending moments caused by the laterally moving ice may well be sufficient to topple the platform. Therefore, offshore structures operating in arctic seas must be able to withstand or overcome the forces created by pressure ridges and moving ice.

In addition to dangers presented by moving ice sheets, a bottom-supported stationary structure is also exposed to ocean currents and/or water waves. Offshore structures must be designed to withstand not only the relatively infrequent impacts of very large waves caused by severe storms, but also the cumulative effect of repeated impacts of smaller waves which are present under most sea states. These wave conditions encompass wave periods in the range of about 6 seconds to 20 seconds.

To withstand periodic wave forces in deep waters (greater than about 300 m), so-called compliant towers have been designed. Compliant towers are bottom-founded structures that do not rigidly resist environmental forces; rather, a compliant tower is designed to yield to the periodic wave forces in a controlled manner. In this respect, the tower is allowed to oscillate a few degrees from vertical in response to the applied periodic wave forces. This oscillation creates an inertial restoring force which opposes the applied periodic wave force.

A compliant tower may be characterized as a beam having one pinned end, one free end, and a variable restoring force applied at and perpendicular to the free end. The restoring force may be, for example, one or more guy wires, buoys, or both. Additional information concerning compliant towers is found in U.S. Pat. No. 4,610,569 entitled "Hybrid Offshore Structure." The '569 patent is incorporated herein by reference in its entirety. The patent issued in 1986 and was assigned to Exxon Production Research Co.

Compliant towers are ideally used in water depths that are greater than 300 meters but less than about 1,000 meters. To increase the depth in which a compliant tower may be economically employed and to provide further resiliency to the tower, the '569 patent offers a hybrid offshore structure having the compliant tower founded on a fixed-base (non-compliant) structure. The compliant tower includes a compliant upper section pivotally mounted to the top of a substantially rigid lower section. In a preferred embodiment of the '569 patent, the pivot point is located above a distance of between about 10 percent and about 50 percent of the total depth of the body of water.

SUMMARY OF THE INVENTION

Arctic conditions severely limit operational opportunities for surface vessels that require open water to operate. Thus, regardless of the arrangement of the production tower, a need exists for an improved arctic production tower that accelerates the process for setting up production operations offshore. Further, a need exists for a subsea production system wherein fluid separation equipment or other drilling or production-related equipment may be set up rapidly.

A subsea production system for conducting hydrocarbon recovery operations in a marine environment is provided. The marine environment represents a body of water having a surface and a seabed. The subsea production system is designed principally for a marine environment that is subject to having floating ice sheets during an operational period as the wellheads, production operational equipment, storage and supporting structure are all located just below the near-surface ice affected zone. The efficiency of installation and significant reduction in capital and operations expense are key features of the invention. However, application to non-Arctic locations is possible if circumstances do not allow a surface-piercing structure.

In one embodiment, the subsea production system includes a production tower. The production tower includes an elongated trussed frame. The production tower has a first end and an opposing second end. The first end of the tower comprises a base residing proximate the seabed. The base is preferably a gravity-base fabricated from a concrete block or heavy steel frames. The second end extends upward in the water column, but terminates below the ice-affecting zone near the water surface.

The subsea production system also includes a landing deck. The landing deck is disposed at the second end of the production tower. The landing deck is configured to receive and releasably attach to a floating drilling unit. Upon installation in the marine environment, the landing deck resides a distance below the water surface sufficient to avoid floating ice sheets. Preferably, this distance is at least 20 meters (66 feet).

The subsea production system further may include one or more fluid storage cells. The fluid storage cells are placed at the seabed and may preferably be incorporated into the base of the production tower. At least one of the fluid storage cells is a hydrocarbon fluids storage cell. The hydrocarbon fluids storage cells receive and temporarily store hydrocarbon fluids recovered during production operations.

The production system may include subsea production operational equipment. The operational equipment resides within the trussed frame of the production tower just below the landing deck. Location of the subsea production operational equipment near the water surface has the benefit of less onerous design requirements for shallow water depths, which translates to lower capital costs to build the equipment. Certain types of equipment, such as low-power gravity separation vessels, can be included in a production system for a deep water depth location that would have precluded their use had all the subsea production equipment been placed on the seabed (the more typical approach). The operational equipment may be, for example, (i) power generation equipment, (ii) pressure pumps, (iii) control valves, (iv) a production manifold, (v) fluid separation equipment, or (vi) combinations thereof.

The subsea production operational equipment is co-located within its own structural frame. This arrangement provides a cost benefit as the equipment is: (1) tested together onshore prior to installation, (2) installed as one unit in a single, quick, offshore operation and (3) tied into wells and storage cells more quickly than typical "spread" subsea architecture.

The production tower is placed at a selected location within the marine environment. A plurality of wells is drilled in the area of the selected location, with each well being completed at the depth of a subsurface reservoir. Further, each well has a wellhead.

In one embodiment, a plurality of wellheads is disposed on or within the trussed frame. Each wellhead receives production fluids from the subsurface reservoir through a surface casing that extends from the seabed and into the trussed frame. A production flowline is then provided for delivering production fluids from the wellheads to the subsea production operations equipment.

In another embodiment, the plurality of wellheads is disposed on the seabed. The production operations equipment receives production fluids from the plurality of wellheads located on the seabed. In this instance, the production tower further comprises one or more production flowlines for transporting production fluids from the respective subsea wellheads to the production operations equipment within the trussed frame.

The subsea production system may also include a production riser. The production riser transfers hydrocarbon fluids from the at least one hydrocarbon fluids storage cell to a transport vessel at the surface. The production riser is in selective fluid communication with the transport vessel.

It is preferred that the subsea production tower be an articulated structure. In this instance, the tower has at least two sections. These may include a substantially rigid lower section and a compliant upper section. The rigid lower section may have a gravity base at the seabed. The rigid lower section extends upwardly from the seabed to a pivot point located intermediate the upper end of the lower section and the lower end of the upper section. The compliant upper section, in turn, extends upwardly from the pivot point to the landing deck. In this way, the compliant upper section is able to pivot relative to the lower section in response to wave energy as described earlier. This compliancy requirement is particularly necessary when the floating drilling unit is attached, due to the large wave forces that may act on the drilling unit The production tower must simultaneously be stiff enough to resist static (non-periodic) wind and current forces.

A method for installing components for a subsea production system is also provided herein. The key advantage of the method is the short "time window" necessary to install each of the components—a key feature in the Arctic environment where icy conditions may limit the "time window" available for installation operations. The subsea production system is installed in a marine environment representing a body of water. The marine environment again has a surface and a seabed.

In one embodiment, the method includes identifying a location in the marine environment for hydrocarbon recovery operations. The method also includes placing one or more hydrocarbon fluids storage cells on the seabed at the selected location, preferably to use as a base for the production tower.

The method further comprises transporting a trussed tower to the selected location. The trussed tower has a first end connecting to the base of the production tower, and an opposing second end comprising a landing deck. The method then includes erecting the trussed tower in the marine environment. In this step, the first end is placed on the seabed proximate the one or more hydrocarbon fluids storage cells.

The operator may determine an anticipated maximum depth of moving ice sheets within the marine environment. The tower is then dimensioned such that the landing deck is below the maximum depth when the trussed frame is erected. Preferably, the landing deck resides at least 20 meters below the surface. In this way the production tower is able to avoid contact with moving ice sheets.

The method further comprises placing subsea production operational equipment within the production tower. Preferably, the production operational equipment is pre-installed into a trussed frame structure that is installed onto the production tower. Alternatively, the production operation equipment is lowered below the water line and secured to the trussed frame after the frame is transported and erected offshore. A hydrocarbon transport line is then connected so as to provide fluid communication between the production operational equipment and the one or more hydrocarbon fluids storage cells.

The operational equipment may include, for example, (i) power generation equipment, (ii) pressure pumps, (iii) control valves, (iv) a production manifold, (v) fluid separators or (vi) combinations thereof.

The method may also comprise drilling a plurality of wells through the seabed and into a subsurface reservoir. Thereafter, the method would include producing hydrocarbon fluids from the subsurface reservoir.

In connection with the drilling, the method also includes transporting a floating drilling unit to the selected location. The floating drilling unit is then attached to the landing deck of the production tower. This may include taking water into ballast tanks to allow the drilling unit to attach to the landing deck. The floating drilling unit is used for drilling operations, for servicing production operations equipment, for drilling remediation operations, or combinations thereof. The floating drilling unit may be removed from the landing deck at the end of an offshore drilling phase. If necessary to avoid a collision with a large floating ice mass, the drilling unit may be temporarily removed from the landing deck and taken to a safe area within the marine environment.

In connection with drilling, the method may further include placing a plurality of wellheads for each well on the production tower. Each wellhead receives production fluids from the subsurface reservoir through a surface casing that extends from the seabed and into the trussed frame. Production flowlines are then installed for delivering production fluids from the respective wellheads to the subsea production operational equipment.

Alternatively, the method may further include placing a plurality of wellheads for each well on the seabed. Production flowlines are then installed for delivering production fluids from the respective wellheads to the subsea production operational equipment. Hydrocarbon fluids are then produced from the subsurface reservoir to the seabed, and then transported to the production operational equipment within the production tower.

The method also includes placing a first end of a production riser in fluid communication with the one or more hydrocarbon fluids storage cells. A second end of the production riser is removably attached to a transport vessel at the surface. This may be, for example, through a flexible top-side hose. Thereafter, the method includes transferring hydrocarbon fluids from the one or more hydrocarbon fluids storage cells to the transport vessel.

BRIEF DESCRIPTION OF THE DRAWINGS

So that the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 4A, is a side view of a location for conducting subsea hydrocarbon production operations. A cluster of hydrocarbon fluids storage cells is being lowered to the seabed at a selected location in the marine environment.

FIG. 4B shows the production tower being erected onto the seabed proximate the hydrocarbon fluids storage cells.

FIG. 4C shows an anchor for a mooring system being lowered to the seabed.

FIG. 4D shows a mooring line being connected between the anchor and the upper end of the production tower.

FIG. 4E shows a floating drilling unit being placed onto a landing deck at the top of the production tower. An additional anchor and corresponding mooring line have been installed as well. It is understood that the components are not to scale.

DETAILED DESCRIPTION OF CERTAIN EMBODIMENTS

Definitions

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "seabed" refers to the floor of a marine environment. The marine environment may be an ocean or sea or any other body of water that experiences waves, winds, and/or currents.

The term "Arctic" refers to any oceanographic region wherein ice features may form therein or traverse through. The term is broad enough to include geographic regions in proximity to both the North Pole and the South Pole.

The term "marine environment" refers to any offshore location. The offshore location may be in shallow waters or in deep waters. The marine environment may be an ocean body, a bay, a large lake, an estuary, a sea, or a channel.

The term "ice sheet" means a floating and moving mass of ice, floe ice, or ice field. The term also encompasses pressure ridges of ice within ice sheets.

The term "landing deck" means any platform dimensioned and configured to receive a drilling unit.

The term "floating drilling unit" means any floating platform on which offshore operations such as hydrocarbon drilling or production operations may take place. A floating drilling unit will typically have a derrick, a kelly, pipe stands, mud pumps, hoists, and so forth.

Description of Specific Embodiments

Figure 1:
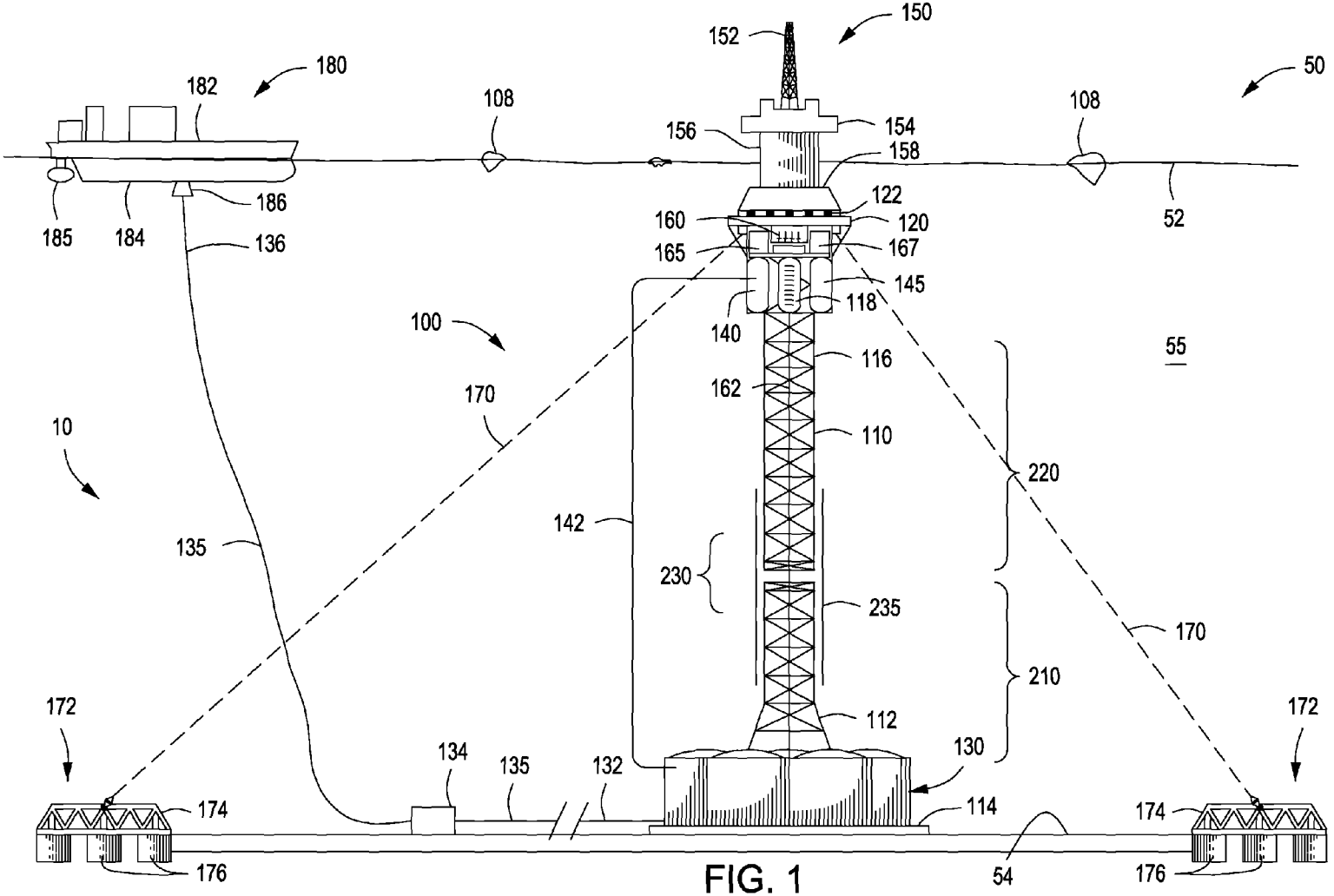
FIG. 1 is a side view of a subsea production system of the present invention, in one embodiment. A production tower and an attached floating offshore drilling unit are seen in a marine environment.

FIG. 1 presents a side view of a subsea production system 10 of the present invention, in one embodiment. The production system 10 operates in a subsea environment. The marine environment 50 represents a body of water 55 having a surface (or water line) 52 and a seabed (or water bottom) 54. The marine environment 50 is preferably an Arctic body of water that experiences substantially icy conditions during much of the year. Examples include the Sea of Okhotsk at Sakhalin Island, as well as the U.S. and Canadian Beaufort Seas.

First, the subsea production system 10 has a production tower 100. The production tower 100 is designed to support a floating offshore drilling unit 150. The production tower 100 includes a landing deck 120 for receiving the drilling unit 150. The production tower 100 and the drilling unit 150 are shown as attached together in the marine environment 50.

In the view of FIG. 1, the marine environment 50 is substantially free of ice. However, two small ice sheets 108 are seen floating along the surface 52. The ice sheets 108 may be of such small size that an impact with the drilling unit 150 is of little concern. If the ice sheets 108 are larger, then they may be broken up using ice breaking vessels. Alternatively, they may be redirected using Arctic-class tug boats.

The floating drilling unit 150 may be of any type, so long as it is configured to releasably attach to the landing deck 120. The illustrative drilling unit 150 of FIG. 1 includes a derrick 152. The drilling unit 150 further includes a platform 154. Together, the derrick 152 and the platform 154 allow an operator to conduct drilling operations, service production operation equipment, drilling remediation operations, or combinations thereof in the marine environment 50.

The floating drilling unit 150 also has a ballasting tower 156. In this illustrative arrangement, the tower 156 defines a substantially cylindrical body that floats in a body of water in an upright position. Such a structure is sometimes referred to in the marine industry as a "caisson." However, the illustrative tower 156 is not limited to caissons or other specific tower arrangements. As the tower 156 floats in accordance with Archimedes principle, it provides support for the derrick 152 and the platform 154. The tower 156 allows the drilling unit 150 to float at the surface 52 of the body of water 55 when it is not attached to the landing deck 120.

The ballasting tower 156 may optionally include operational equipment. Such equipment may include shale shakers, mud pumps, fluid storage tanks, crew quarters, and other facilities for drilling and production operations. Thus, the tower 156 may additionally be used as a storage facility for equipment and supplies, and as living quarters.

The floating drilling unit 150 is configured to releasably attach to the landing deck 120. To provide for attachment, the drilling unit 150 includes a base 158. The base 158 may have connection pipes or support members 122. The support members 122 are connected to an undersurface of the base 158 and then connect to the landing deck 120.

U.S. Pat. No. 3,412,564 titled "Sub-Sea Working and Drilling Apparatus" describes a subsea base structure 30 having legs 33 extending from the ocean floor up to a submerged platform 31. The platform 31 is placed a sufficient depth below the water surface to reduce wave action and to avoid navigational hazards. The platform 31 includes means for locating and laterally coupling a floatable structure. Such an arrangement may be used with the production tower 100 herein. The '564 patent is incorporated herein in its entirety by reference. Note, however, that those of ordinary skills in the art can clearly see the method described in '564 is not technically feasible. The technical difficulty with '564 is the enormous loading that a caisson structure will pass on to the relatively rigid support structure 30. In general, large caisson-type floating structures will generate large wave loading if not allowed to move. For example, ships at anchor, or moored, still move in response to wave periodic loading. The anchor or mooring lines do not restrain the ship rigidly, rather keeping the ship from drifting away. The movement of the ship produces inertial loading (mass time acceleration) than can resist the periodic wave loading. Thus, if the floating caisson is supported in a compliant manner, as with the present invention, the loading is greatly reduced. This hydrodynamic description is not included in '564.

It is understood that the production tower 100 is not limited by the arrangement for connecting the drilling unit 150 to the landing deck 120. Preferably, however, the connection readily permits the drilling unit 150 to be detached from the landing deck 120 and floated away to temporarily avoid a large ice sheet.

The tower 156 contains controllable ballast compartments. The ballast compartments selectively receive and release water. This allows the operator to selectively raise and lower the height of the drilling unit 150 relative to the surface 52 of the body of water 55. This, in turn, facilitates the selective attachment of the base 158 on the landing deck 120.

Referring again to the production tower 100, the tower 100 defines an elongated trussed frame 110. The production tower 100 has a first end that operates as a base 112. The base 112 is configured to be landed on the gravity foundation including optional storage cells 130 when the production tower 100 is erected. Preferably, the gravity foundation includes a concrete pad 114.

In addition to the production tower 100 and the drilling unit 150, the subsea production system 10 also includes one or more fluid storage cells 130. The fluid storage cells 130 reside at the seabed 54 proximate the base 114. At least one of the one or more fluid storage cells 130 is a hydrocarbon fluids storage cell. The hydrocarbon fluids storage cells receive hydrocarbon fluids from production operations. Those of ordinary skill in the art will understand that the production tower 100 exists to recover valuable hydrocarbon fluids from a subsurface reservoir (not shown).

It is noted that the production tower 100 also has a second opposite end 116. The second end 116 includes the landing deck 120. The subsea production tower 100 includes fluid separation equipment 140. The tower 100 may include subsea production operational equipment 165, 167 in addition to the fluid separation equipment 140.

Fluid separation equipment 140 is also placed along the frame 110 as part of the subsea production system 10. The fluid separation equipment 140 operates to separate different fluid components within the production fluids. Such components primarily include hydrocarbons and water. The hydrocarbon fluid components will typically represent both natural gas (recovered principally as methane and ethane) and hydrocarbon liquids (or oil). The hydrocarbon fluid components will be released from the fluid separation equipment 140 and subsea production operational equipment 165, 167 through a hydrocarbon transport line 142, and into the fluid storage cells 130.

The fluid separation equipment 140 is preferably placed proximate the second end 116 of the trussed frame 110. For example, the fluid separation equipment may reside a distance from the landing deck that is within about 20% of the overall height of the production tower. Those skilled in the art will understand that fluid separation equipment can be designed to less onerous hydrostatic loading conditions if it is located near the water surface versus placed on the seabed.

The fluid separation equipment 140 may include one or more gravity separators, one or more centrifugal separators, heat separation equipment, distillation vessels, counter-current contactors, or other fluid separation equipment known in the fluid processing industry. The fluid separation equipment 140 may include a water treatment facility 145. Separated water is directed into the water treatment facility 145. The water may then be released into the body of water 55 or, optionally, reinjected into the subsurface reservoir (not shown) for storage or for water flooding purposes.

As can be seen, the additional operational equipment 165, 167 also resides above the seabed 54 and along the trussed frame 110. The production operational equipment may be, for example, (i) power generation equipment, (ii) pressure pumps, (iii) control valves, (iv) production manifold lines, or (v) combinations thereof.

Yet an additional optional feature of the subsea production system 10 includes the placement of wellheads within the production tower 100. In FIG. 1, a plurality of wellheads is shown schematically at 160. Each wellhead 160 represents a well that has been formed through the seabed 54 and into a subsurface reservoir. Fluid communication between the subsurface reservoir and the various wellheads 160 is provided through strings of casing. In FIG. 1, strings of surface casing are indicated together at line 162. The strings of surface casing 162 extend from the seabed 54 and through the trussed frame 110.

The subsea production system 100 also includes a production riser 135. The production riser 135 has a first end 132 in fluid communication with the hydrocarbon fluid storage cells 130. The production riser 135 may optionally extend along the seabed 54 for a distance where it may tie into a subsea control unit 134. The production riser 135 then extends upward from the control unit 134, and terminates at a second end 136. The second end 136 releasably connects to a fluid transport vessel 180 at the water surface 52.

The fluid transport vessel 180 may be any type of vessel known in the marine industry for transporting large volumes of fluid. In the illustrative arrangement of FIG. 1, the vessel 180 has a deck 182, a hull 184, and a steering system 185. The steering system 185 will typically include dynamic thrusters. The steering system will likely also include a global positioning system, sensors, and computer-controlled propellers.

The vessel 180 will have an intake fitting 186 for releasably connecting the second end 136 of the production riser 135 to the hull 184. In this way, hydrocarbon fluids may be loaded onto the fluid transport vessel 180.

In the illustrative arrangement of FIG. 1, the second end 136 of the riser 135 is shown tied directly into the hull 184 of the vessel 180. However, it is understood that the riser 135 may be placed in fluid communication with the hull 184 through a flexible top-side hose (not shown).

The hydrocarbon fluids loaded onto the fluid transport vessel 180 may be a mixture of natural gas and oil. The hydrocarbon fluids may have sour gas components such as carbon dioxide, hydrogen sulfide, and mercaptans in them as well. Further, the hydrocarbon fluids may include helium, nitrogen, or other gaseous components. Therefore, the fluid transport vessel 180 will deliver the hydrocarbon fluids to a fluids processing facility (not shown) for further separation and hydrocarbon refining.

In order to augment the capability of the drilling unit 150 to stay connected to the production tower in the marine environment 50, a plurality of mooring lines 170 is optionally provided. The mooring lines 170 circumscribe the production tower 100 to provide added load resistance capability and/or station-keeping. Station-keeping is important during hydrocarbon recovery operations to maintain the drilling unit 150 in proper position over the seabed 54 while a wellbore (not shown) is being formed or produced from.

At one end, each mooring line 170 is connected to the production tower 100. In the illustrative arrangement of FIG. 1, the mooring lines 170 are connected to the tower 100 at or proximate to the landing deck 120. However, the mooring lines 170 may optionally be connected at a location along the trussed frame 110 proximate the second end 116 of the tower 110.

At the opposite end, each mooring line 170 is connected to an anchor 172. In the view of FIG. 1, only two mooring lines 170 and two anchors 160 are shown. However, it is understood that the subsea production system 10 preferably includes at least four and, more preferably six to ten mooring lines 170 and corresponding anchors 172.

Each anchor 172 rests on the seabed 54 at a designated distance from the tower 100. The anchors 172 are disposed radially around the tower 100 along the seabed 54. The anchors 172 shown in FIG. 1 comprise steel frames 174 forming a lattice that is secured to the seabed 54 through individual suction piles 176. The piles 176 may be secured to the seabed 54 by pile driving, suction driving, or other means known in the art. The use of multiple piles 176 connected through a steel lattice increases the tensile strength and resistance capacity of the anchors 172. Alternatively, the anchors 172 may be concrete (or other) gravity based pads.

The mooring lines 170 may be maintained in a state of tension with at least a small degree of slack.

The mooring lines 170 may be conventional wires, chains or cables. Alternatively; the mooring lines 170 may define multiple links (not shown) of substantially rigid members. Each link may represent, for example, a set of two or three individual eyebars in parallel. The links, in turn, are connected at respective ends by connectors. The use of multiple links and the corresponding increase in cross-sectional area of steel substantially increases the tensile capacity of the mooring lines 170. Additional details concerning the use of links in a mooring system are described in U.S. Pat. Appl. No. 61/174,284 filed Apr. 30, 2009, and entitled "High Arctic Floating Driller."

To further assist the subsea production tower 100 to resist ice loading and/or station-keeping, a ballast system may be provided within the trussed frame 110. In the arrangement of FIG. 1, a ballasting compartment is provided at 118. The ballasting compartment 118 may be a series of ballasting tanks. The ballasting compartment 118 resides proximate the second end 116 of the production tower 100. During drilling and production operations, the ballasting compartment 118 is preferably substantially emptied of sea water. This creates an upward force on the production tower 100, and helps resist loading imposed on the drilling unit 150 when it is attached to the landing deck 120.

It is noted that steel trussed frames can be susceptible to fatigue induced by waves and water currents. Offshore steel frames must be designed to withstand the cumulative effect of repeated impacts of waves, even smaller waves. When a wave impacts on an offshore structure, it causes both rigid oscillation and vibration generally known as a wave dynamic response. Thus, at the same time, the tower oscillates in the manner of an inverted pendulum and vibrates in the manner of a bowstring. If the flexural vibration period of the structure falls within the range of wave periods likely to contain significant amounts of energy, (i.e., 6 seconds to 20 seconds), the structure will resonate under certain conditions. Resonance of the structure is likely to impose excessive forces on the structure and may result in fatigue damage. Accordingly, offshore structures should be designed so that the flexural vibration period of the structure falls outside the range of wave periods likely to contain significant amounts of energy.

It is also preferred that the trussed frame 110 in FIG. 1 be an articulated frame. Thus, in FIG. 1, the frame 110 includes a substantially rigid lower section, identified by bracket 210, and a compliant upper section, identified by bracket 220. In addition, the frame 110 includes a pivot point located intermediate the first end 112 and the second end 116 of the trussed frame 110. The pivot point is indicated by separate bracket 230.

It is again noted that the mooring lines 170 may be arranged to have some slack in them. This permits the upper compliant section 220 some freedom of movement. The mooring lines 170 permit the production tower 100 to pivot a few degrees from vertical about its base 114 in response to surface wind, wave, or current forces, thereby creating inertial forces which counteract the applied forces. This compliance ability is particularly necessary for the reduction of periodic wave loading for the situation in which a caisson-like driller is landed on the production tower.

The ballasting compartment 118 and the mooring lines 170 are preferably designed so that the oscillation period of the production tower 100 in response to marine environmental forces is greater than about 20 seconds. Thus, the oscillation period falls outside the range of wave periods likely to contain significant amounts of energy.

The production tower 100 is intended primarily, though not exclusively, for hydrocarbon recovery operations taking place in water depths between 300 and 1,000 meters (984 to 3,281 feet). A pivot point 230 is not required. Further, if a pivot point 230 is used, it is preferred that the pivot point 230 be within the bottom half of the length of the trussed frame 110. For purposes of this measurement, the length of the trussed frame is generally from the seabed 54 to the landing deck 120.

In the illustrative arrangement for the production tower 100 of FIG. 1, a pivoting arrangement is provided through a series of piles 235. The piles 235 cross the pivot point 230 and traverse portions of the lower substantially rigid section 210 and the upper compliant section 220. The piles 235 are disposed generally equi-distantly and radially around the trussed frame 110. While only two piles 235 are shown in FIG. 1, preferably 6 to 10 piles 235 are employed.

Figure 2B:
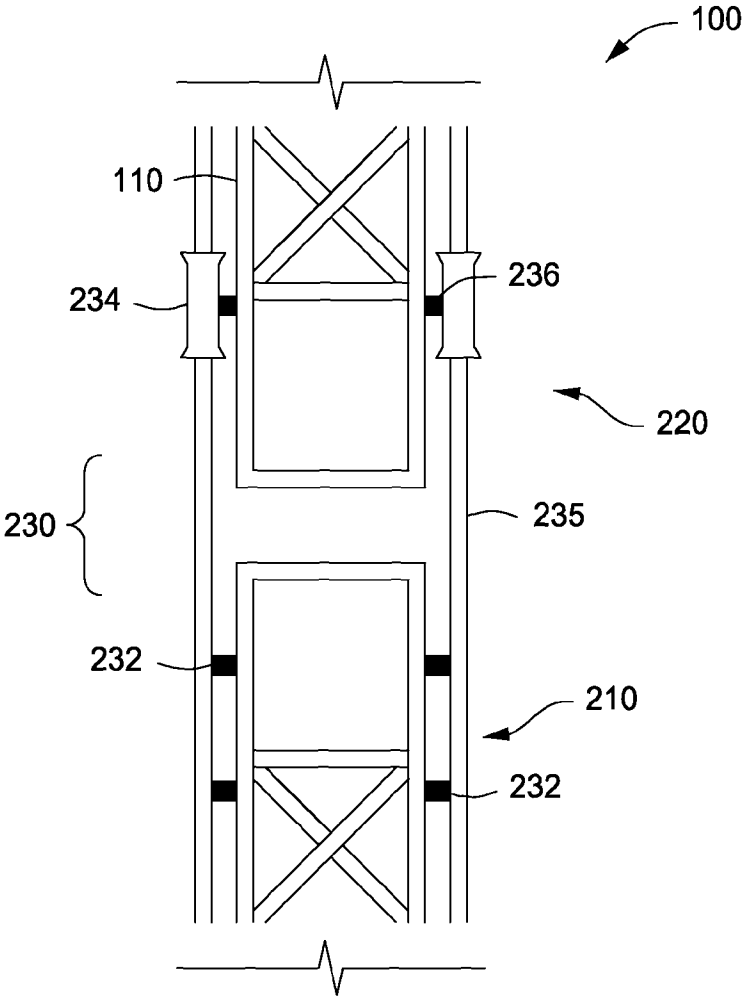
FIG. 2B shows a partial side view of the production tower of FIG. 1, in an alternate embodiment. Here, pile guides are connected to a compliant upper section of the tower. A pivot point is again seen along the tower.
Figure 2A:
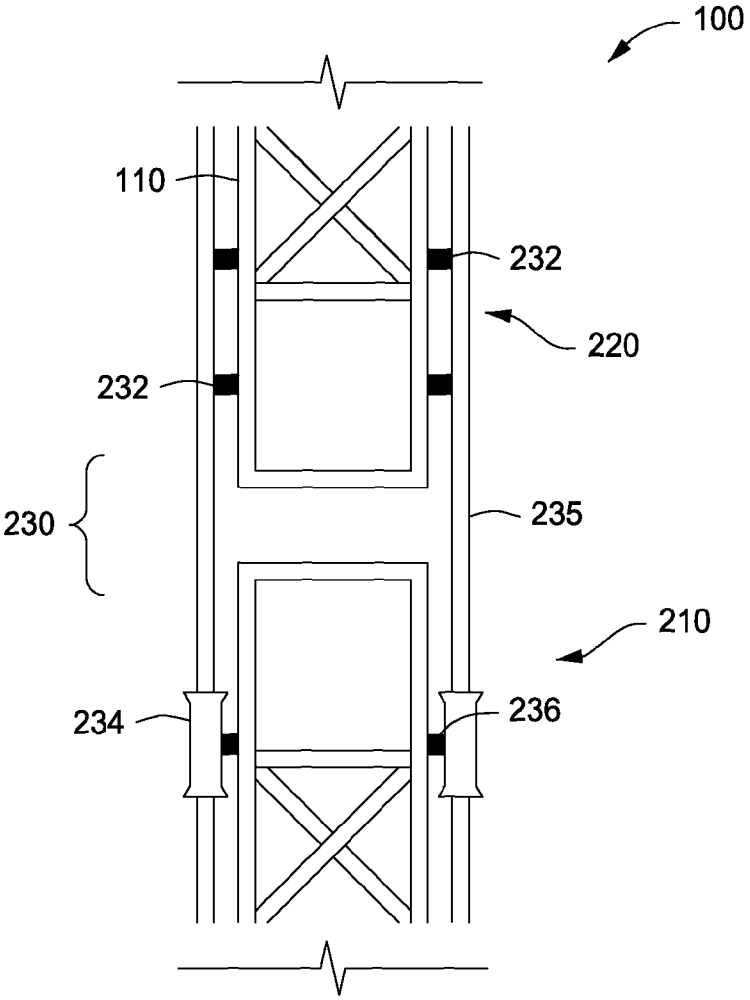
FIG. 2A shows a partial side view of the production tower of FIG. 1, in one embodiment. Here, pile guides are connected to a substantially rigid lower section of the tower. A pivot point is seen along the tower.

FIGS. 2A and 2B demonstrate alternate connection arrangements. Movement of the piles 235 is accommodated through corresponding pile guides 234. The pile guides may be fixed to either the lower substantially rigid section 210 or the upper compliant section 220.

FIG. 2A shows a partial side view of the production tower 100 of FIG. 1, in one embodiment. Here, the piles 235 are fixedly attached to the compliant upper section 220 through connection frames 232. The piles 235 are slideably received within the corresponding pile guides 234.

The pile guides 234 are connected to the substantially rigid lower section 210 of the tower 100. Connection frames are seen at 236. As the compliant upper section 220 oscillates, it pivots about the pivot point 230. The piles 235 reciprocate through the pile guides 234. Preferably, biasing springs (not shown) or other counter-acting members are provided along the pile guides 234 to provide resistance to the piles 235.

FIG. 2B shows a partial side view of the production tower 100 of FIG. 1, in an alternate embodiment. Here, the piles 235 are fixedly attached to the substantially rigid lower section 210 through connection frames 232. The piles 235 are slideably received within corresponding pile guides 234.

The pile guides 234 are connected to the compliant upper section 220 of the tower 100. Connection frames are seen at 236. As the compliant upper section 220 oscillates, it again pivots about the pivot point 230. The piles 235 reciprocate through the pile guides 234.

Figure 3A:
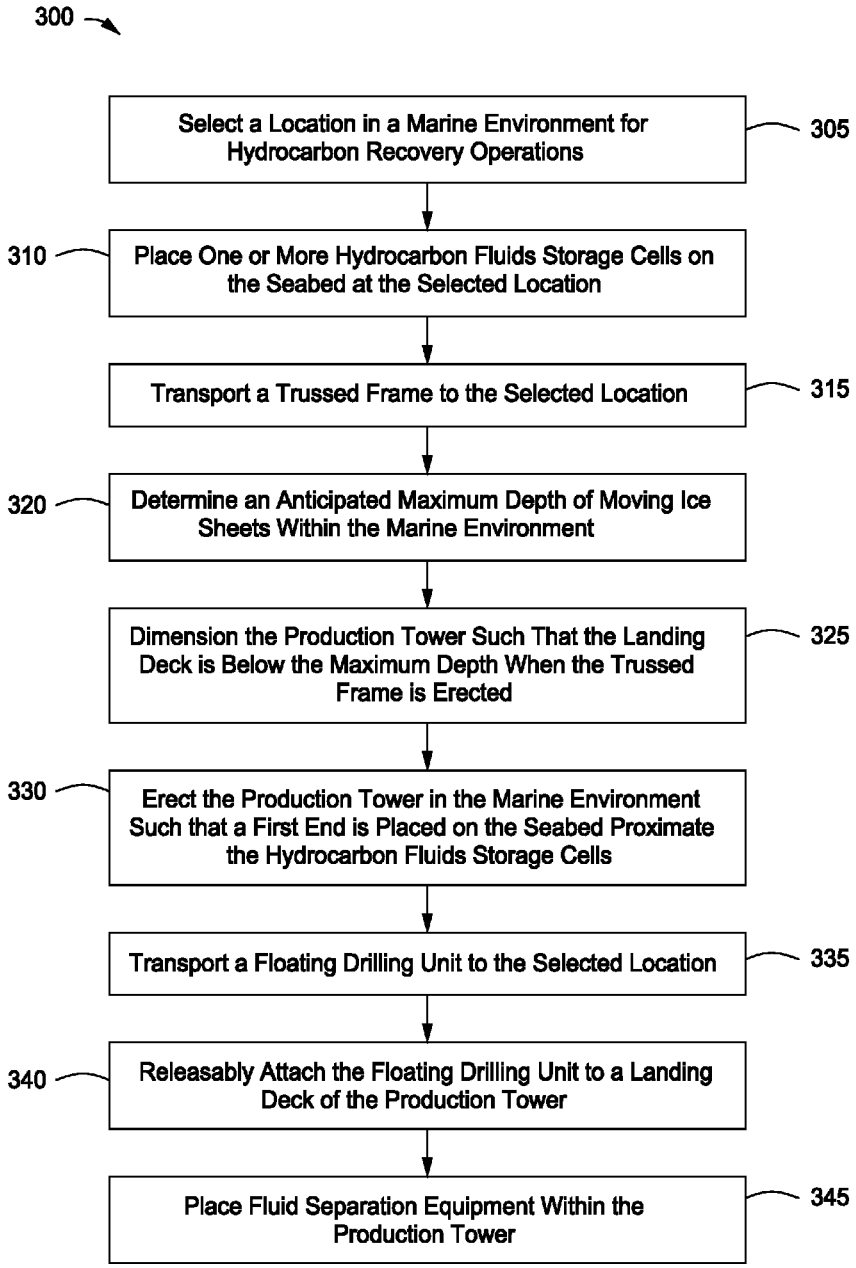
FIGS. 3A and 3B together provide a single flowchart. This is for a method for installing components for a subsea production system in a marine environment. The components will include a production tower having subsea production operational equipment residing thereon.
Figure 3B:
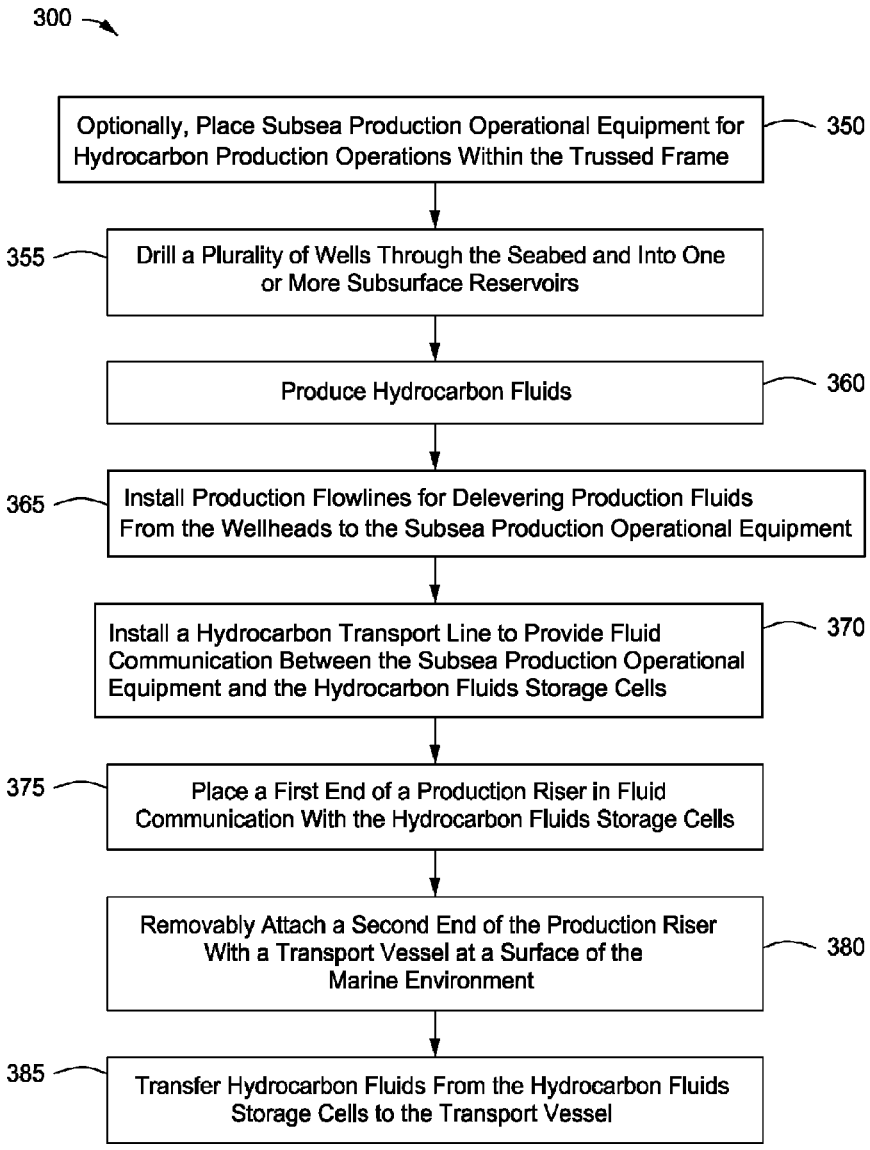

A method for installing components for a subsea production system is also provided herein. FIGS. 3A and 3B together provide a single flowchart showing a method 300 for installing components for a subsea production system. The production system is installed in a marine environment representing a body of water. The marine environment also has a surface and a seabed.

In one embodiment, the method 300 includes identifying a location in the marine environment for hydrocarbon recovery operations. This is shown at Box 305 of FIG. 3A. The identifying step of Box 305 may mean that a location is selected for the drilling of wells. Alternatively, the identifying step may mean that the location has already been selected, and the operator is moving subsea production equipment to that location.

The method 300 also includes placing one or more hydrocarbon fluids storage cells on the seabed at the selected location. This is provided at Box 310. The hydrocarbon fluids storage cells may be in accordance with storage cells 130 of FIG. 1.

It is understood that the storage cells 130 may include more than just hydrocarbon fluids storage cells. The storage cells 130 may also include storage cells for storing water or separated gaseous components.

Figure 4A:
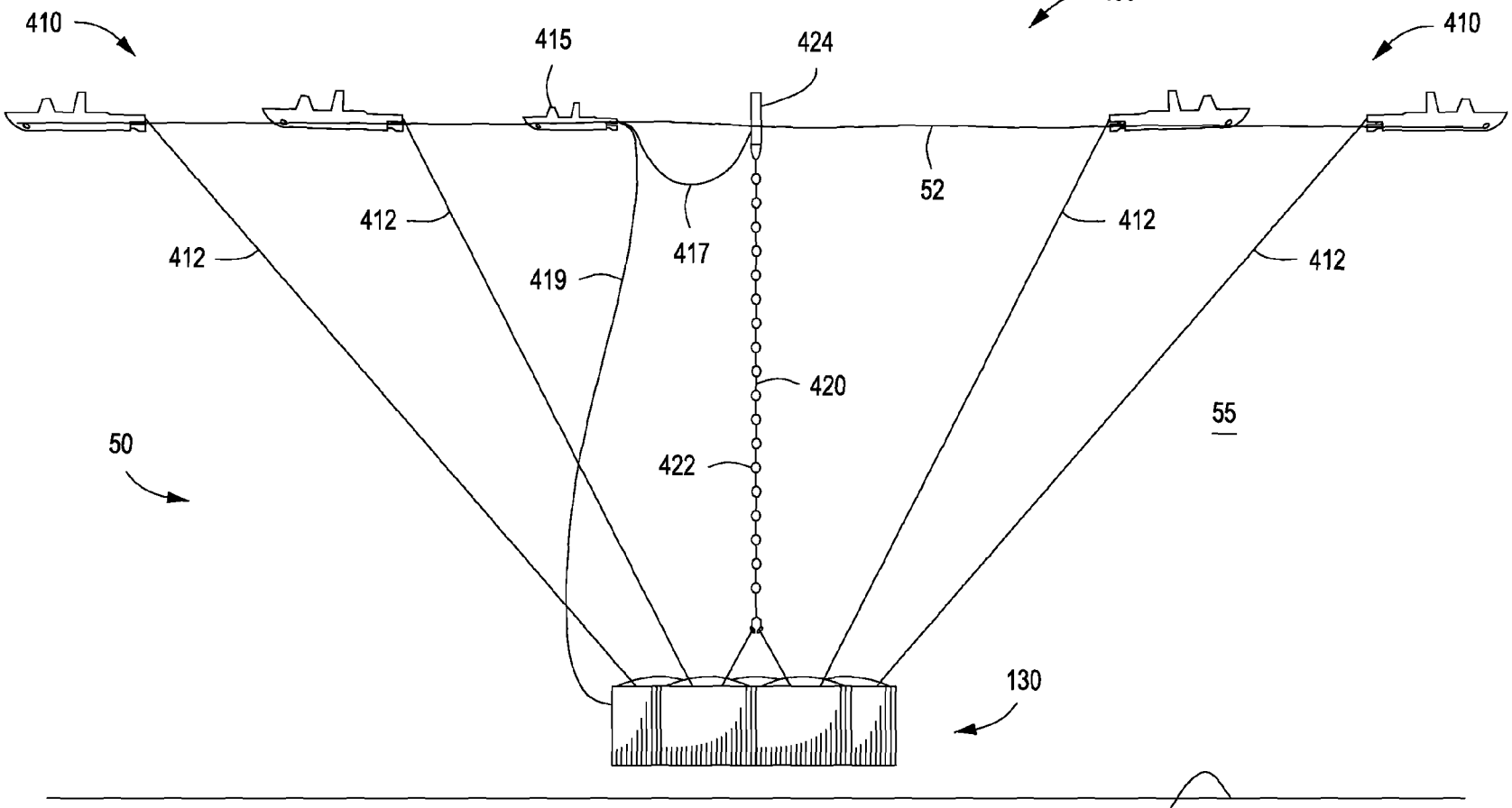
FIGS. 4A through 4E present a series of steps that may be taken for installing a subsea production system in accordance with the flowchart of FIGS. 3A and 3B. In each figure, a marine environment representing a body of water having a surface and a seabed is shown.

FIG. 4A is a side view of a location 400 for conducting subsea hydrocarbon production operations. In this view, equipment for a subsea production system is being installed in a marine environment 50. The marine environment 50 in FIG. 4A is the same as the marine environment 50 in FIG. 1. In this respect, the marine environment 50 again represents a body of water 55 having a surface (or water line) 52 and a seabed (or water bottom) 54.

In FIG. 4A, a cluster of hydrocarbon storage cells 130 is being lowered to the seabed 54 at the selected location 400 in the marine environment 50. To accomplish this, the storage cells 130 have been harnessed together. The storage cells 130 are then lowered into the body of water 55 together using a buoy line 420.

The buoy line 420 represents a steel cable or other strong line having a series of small buoys 422 disposed therealong. In addition, a large surface buoy 424 may be used to aid in controllably lowering the storage cells 130 and in confirming the geo-position of the cells 130 from the surface 52.

To transport the storage cells 130 to the marine location 400, a cluster of work boats 410 is employed. Each work boat 410 has at least one tether 412. The respective tethers 412 are tied to the storage cells 130 and are generally kept in tension. The work boats 410 are arranged in a circle. Upon reaching the location, the diameter of the circle is slowly reduced, thereby permitting the tethers 412 to lower the storage cells 130 into the body of water 55. Alternatively or in addition, the tethers 412 are unspooled from a winch (not shown).

A separate work boat 415 may be used to provide control. For example, the work boat 415 may use control line 417 to operate a pump (not shown) to selectively fill and empty the surface buoy 424 of sea water. Similarly, control line 419 may be used to operate a pump that selectively fills and empties storage cells 130 and to monitor conditions of the storage cells 130.

The method 300 also comprises transporting a production tower to the selected location. This is seen at Box 315. The production tower may be in accordance with tower 100 of FIG. 1. The production tower 100 preferably includes a trussed frame 110. The production tower 100 has a first end 112, and an opposing second end 116 comprising a landing deck 120.

The method 300 further includes erecting the production tower 100 in the marine environment 50. This is indicated at Box 330. In this step, the first end 112 is placed on the seabed proximate the one or more hydrocarbon fluids storage cells.

Figure 4B:
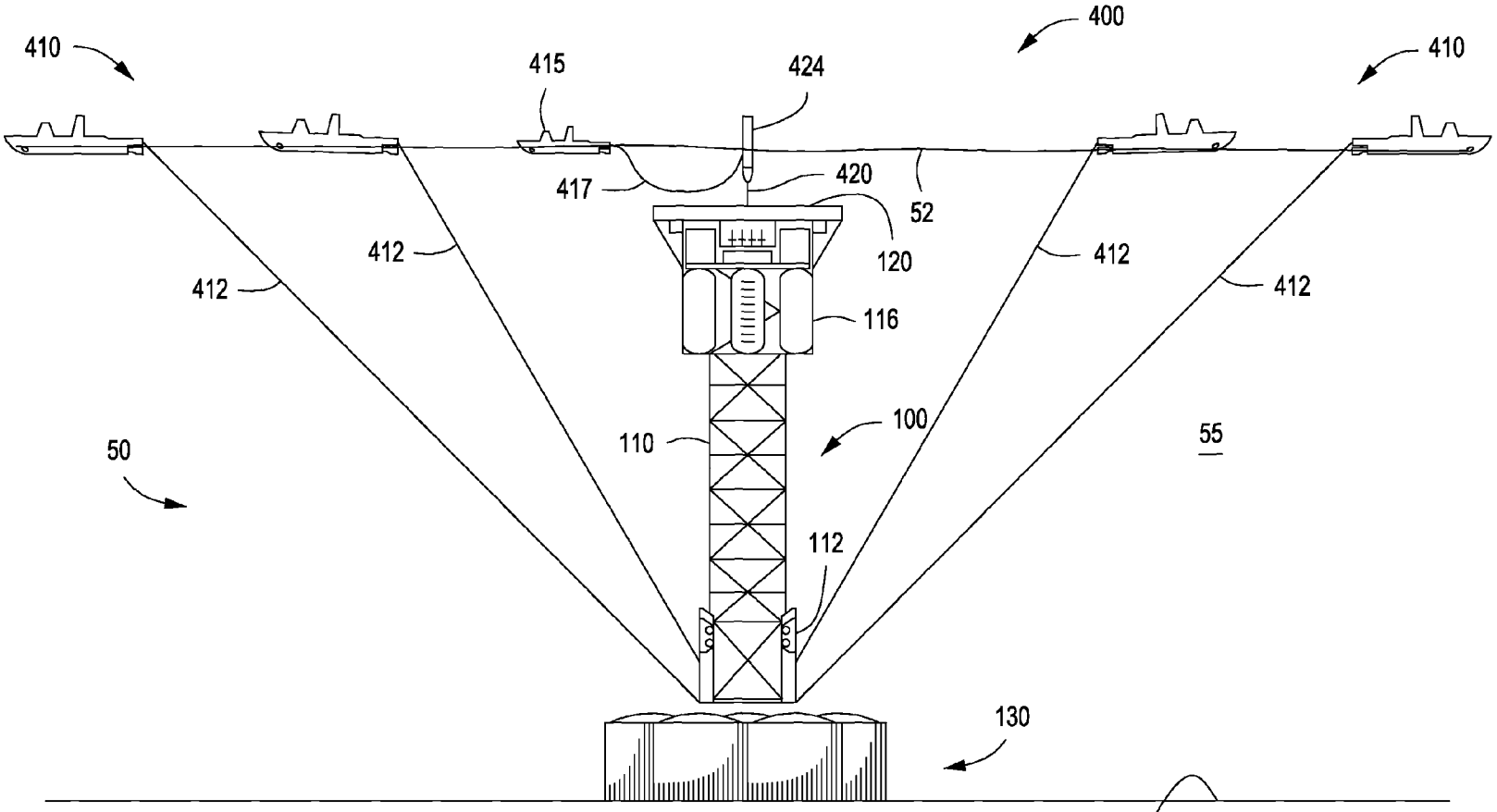

FIG. 4B is another side view of the location 400 from FIG. 4A. In this view, the production tower 100 has been transported into the marine environment 50. In addition, the production tower 100 is being erected by landing the tower 100 onto the seabed 54.

It can be seen in FIG. 4B that the base 112 of the production tower 100 is being lowered near or even into the cluster of fluid storage cells 130. To accomplish this, the buoy line 420 is connected to the landing deck 120 or other area near the second end 116 of the tower 100. The large surface buoy 424 is connected to the buoy line 420 to aid in controllably erecting the production tower 100 and in confirming the geo-position of the tower 100 from the surface 52.

To transport the production tower 100 to the marine location 400, a cluster of work boats 410 is again employed. Each work boat 410 has at least one tether 412. The respective tethers 412 are tied to the first end 112 of the tower 100 and are generally kept in tension. The work boats 410 are arranged in a circle. Upon reaching the location, the diameter of the circle is slowly reduced, thereby permitting the tethers 412 to lower the production tower 100 into the cluster of storage cells 130. Alternatively or in addition, the tethers 412 are unspooled from a winch (not shown).

A separate work boat 415 may be used to provide control. A control line 417 may again operates a sea water pump to selectively fill and empty the surface buoy 424 of sea water.

The production tower truss frame 110 may itself be installed in segments. For example, (i) a truss tower is installed on the base followed by (ii) a frame containing the fluid separation equipment, followed by (iii) a frame containing the other subsea operational equipment, followed by (iv) the landing deck, or (v) combinations thereof.

Figure 4C:
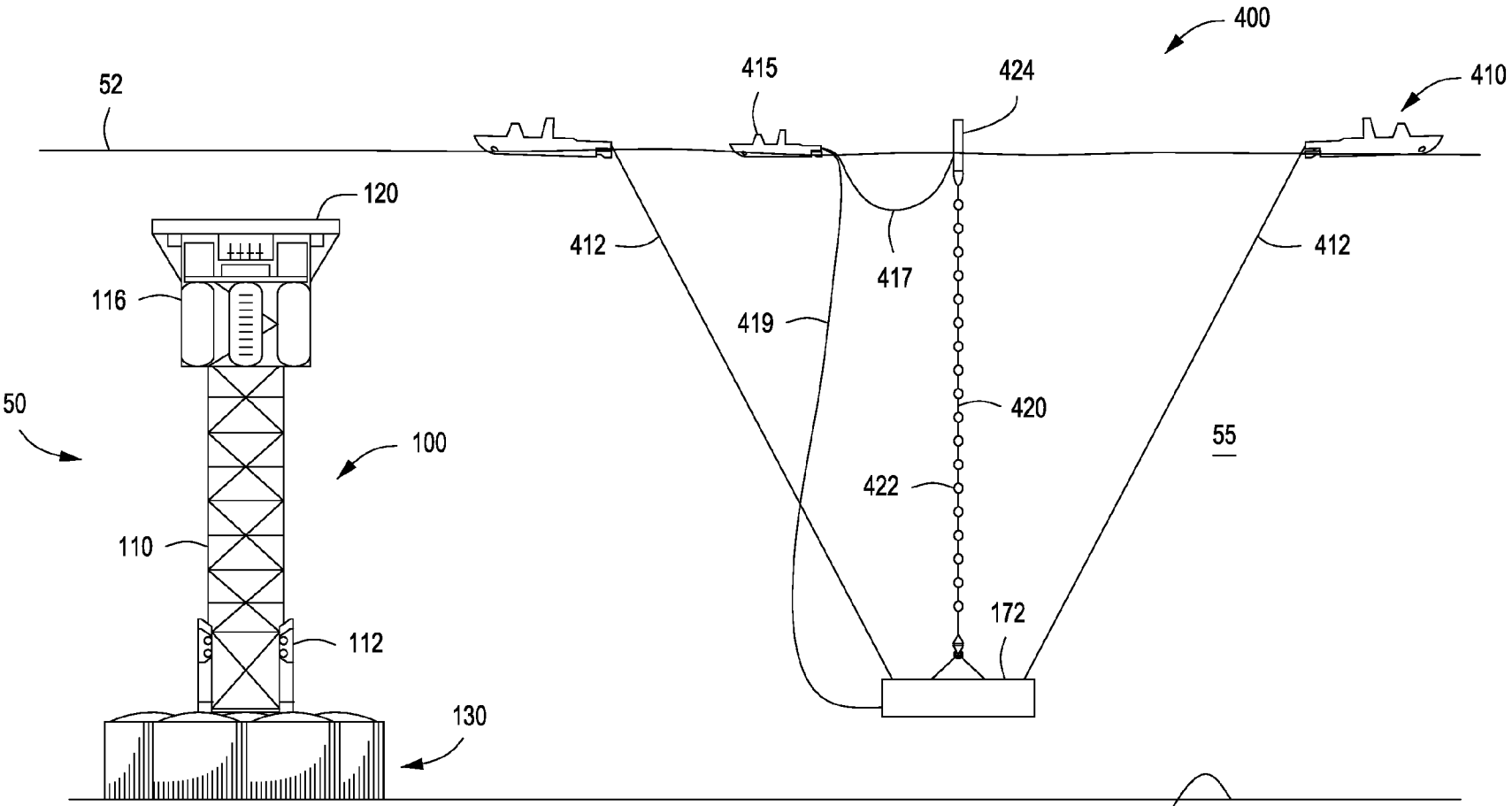

As discussed in connection with FIG. 1, it may be desirable to employ a series of mooring lines 170 around the production tower 100, with each mooring line 170 connected to an anchor 172. FIG. 4C is another side view of the location 400 for conducting subsea hydrocarbon production operations. In this view, an anchor 172 is being transported into the marine environment 50 at the location 400.

In the illustrative arrangement of FIG. 4C, the anchor 172 is a gravity based block. The anchor 172 is preferably fabricated from concrete that is reinforced with steel rebar. The block forming the anchor 172 may be, for example, 10 meters long, 20 meters wide and 10 meters thick. Alternatively, the block forming the anchor 172 may be up to about 100 meters long, 100 meters wide, and 20 meters thick. Other dimensions, of course, may be employed depending on the load-carrying capacity needed for the mooring system. The gravity-based anchor 172 resists the tension of the mooring lines 170 by its weight. The weight of the anchor 172 provides resistance to the vertical component of tension generated within the mooring line 170. At the same time, the weight provides frictional resistance to the horizontal component of the tension.

To lower the anchor 172 to the seabed 54, the anchor 172 is tied to a tether 412. The tether 412, in turn, is controlled from the surface 52 using one or more work boats 410.

In addition to the tethers 412, the anchor 172 is connected to a buoy line 420. The buoy line 420 again represents a steel cable or other strong line having a series of small buoys 422 disposed therealong. In addition, the large surface buoy 424 is used to aid in controllably lowering the anchor 172 and in confirming the geo-position of the anchor 172 from the surface 52.

A separate work boat 415 may be used to provide control. For example, the work boat 415 may use control line 417 to operate a pump (not shown) that selectively fills and empties the surface buoy 424 of sea water. Similarly, control line 419 may be used to control equipment during descent and to monitor equipment conditions.

Figure 4D:
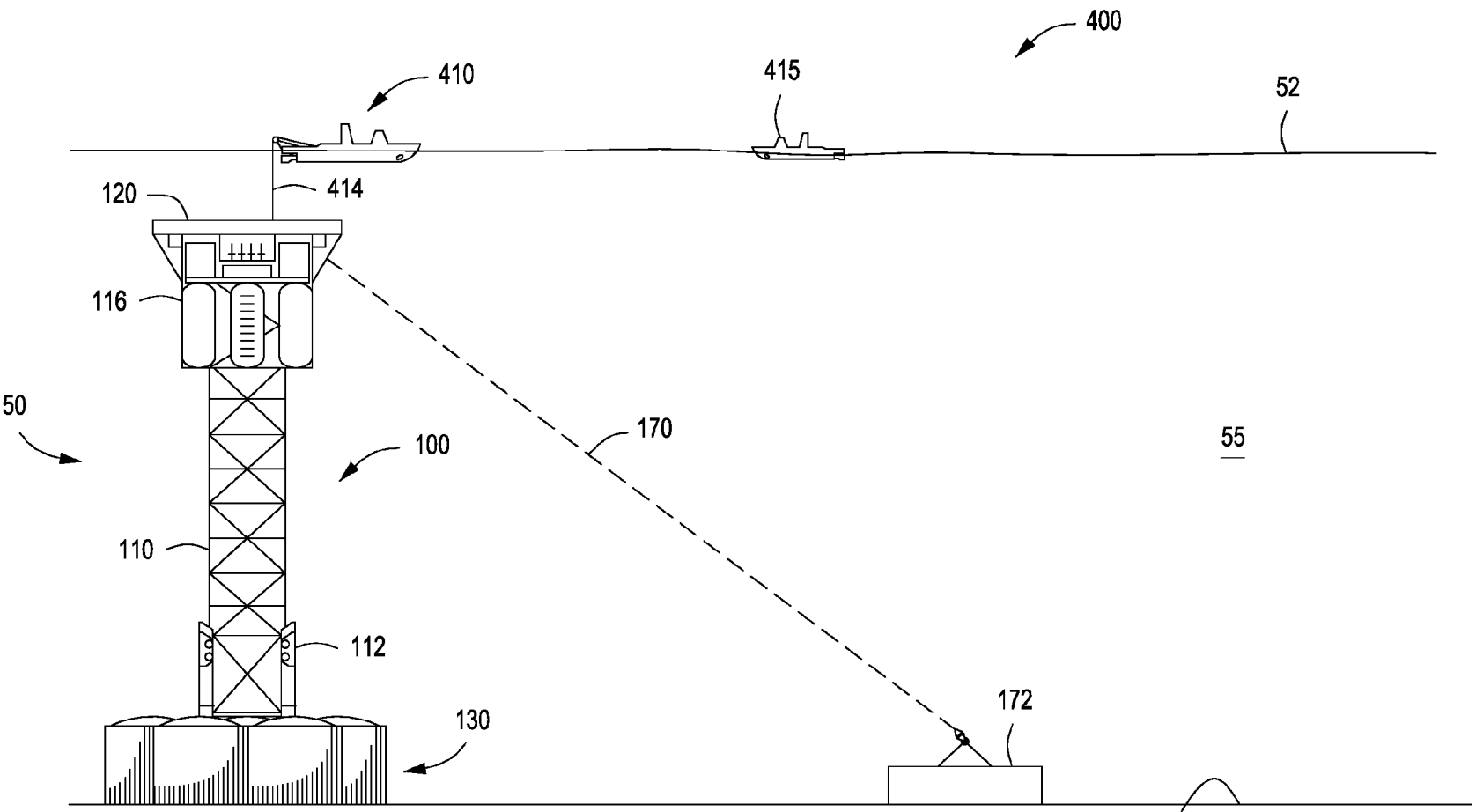

FIG. 4D presents yet another side view of the location 400 for conducting subsea hydrocarbon recovery operations. In this view, the anchor 172 has been placed on the seabed 54. In addition, a mooring line 170 is connected between the anchor 172 and the upper end 116 of the production tower 100.

To make the connection for the mooring line 170, a work boat 410 may be used. Here, the work boat 410 is employing a working line 414 to connect the mooring line 170 to the production tower 100.

Figure 4E:
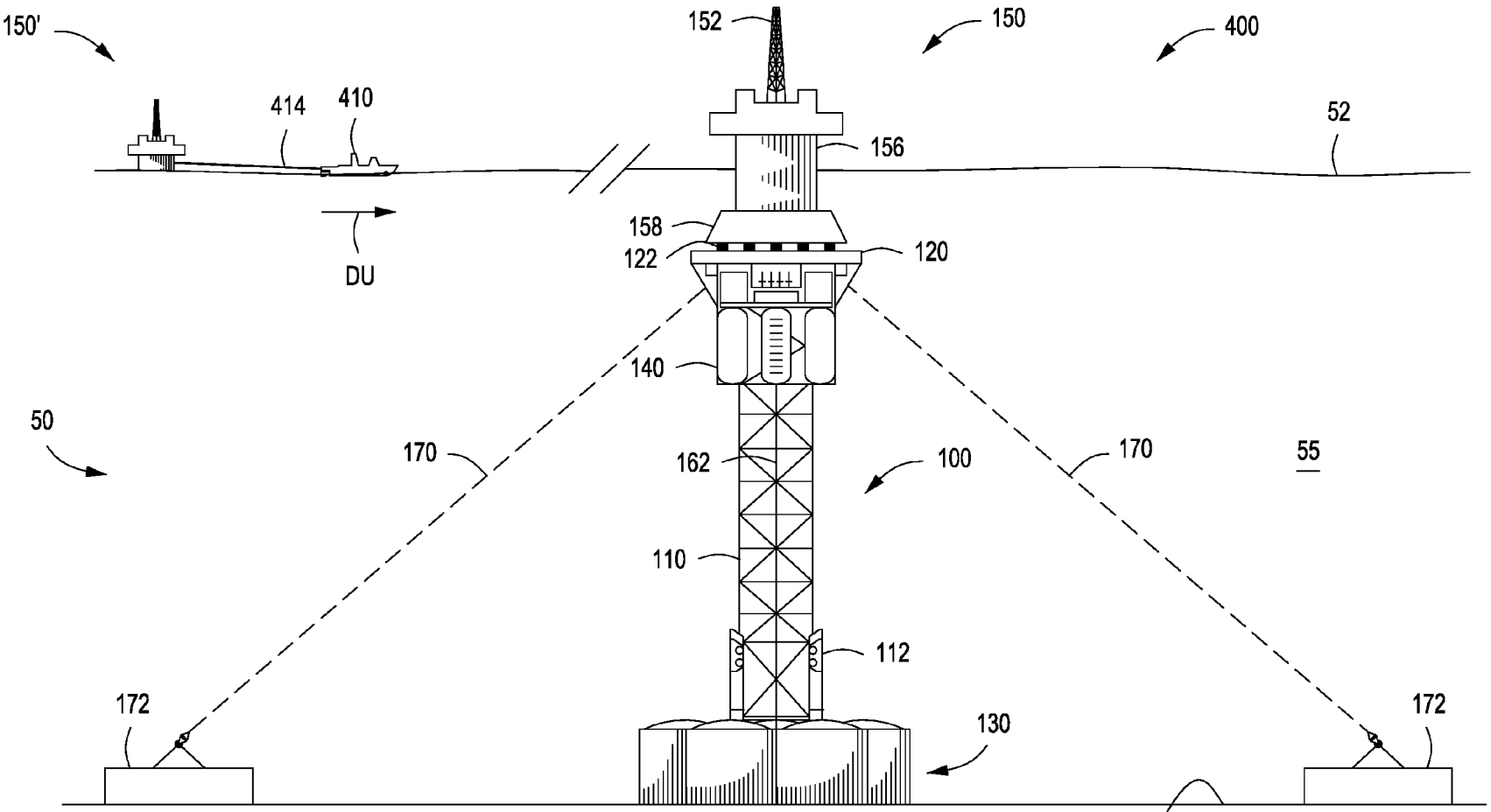

As noted above in connection with FIG. 1, more than one mooring line 170 and more than one corresponding anchor 172 may be used in the subsea production system 10. FIG. 4E shows still another side view of the location 400 for conducting subsea hydrocarbon recovery operations. In this view, a second mooring line 170 and a second corresponding anchor 172 have been positioned in the marine environment 50. The mooring lines 170 help maintain stability for the erected production tower 100.

In connection with erecting the tower 100, the operator or designer may determine an anticipated maximum depth of ice sheets moving within the marine environment. Box 320 shows the step of determining an anticipated maximum depth of moving ice sheets.

The method 300 may also include dimensioning the production tower 100 such that the landing deck 120 is below the maximum depth when the tower 100 is erected. This is shown at Box 325. Preferably, the landing deck 120 resides at least 20 meters below the water surface 52. In this way the production tower 100 is able to avoid impact from any ice sheets.

The method 300 also includes transporting a floating drilling unit to the selected location. This is seen in Box 335. The floating drilling unit may be in accordance with drilling unit 150 of FIG. 1. The floating drilling unit is used for drilling operations, for production operations, for remediation operations, or combinations thereof.

Returning to FIG. 4E, FIG. 4E shows the transporting of the floating drilling unit 150' to the location 400 in the marine environment 50. The drilling unit 150' is being pulled by one or more work boats 410 using working line 414. The drilling unit 150' is being moved in the direction indicated by arrow "DU."

The method 300 further includes attaching the floating drilling unit 150' to the landing deck 120 of the production tower 100. This is provided at Box 340. In FIG. 4E, the landed drilling unit is shown at 150. The connection between the drilling unit 150 and the landing deck 120 is releasable so that the drilling unit 150 may be quickly removed from the landing deck 120 at the end of the drilling phase, or during operations to avoid a large ice sheet.

To attach the drilling unit 150 to the production tower 100, water compartments within the caisson 156 are at least partially filled with sea water to cause the drilling unit 150 to land on the landing deck 120. The support members 122 will land in mating receptacles (not shown) in the landing deck 120 to attach the drilling unit 150 to the production tower 100.

The method 300 also comprises placing fluid separation equipment within the production tower 100. This is shown at Box 345 of FIG. 3A. The fluid separation equipment may be in accordance with the fluid separation equipment 140 discussed above. The fluid separation equipment 140 may be placed on the production tower 100 before the production tower 100 is erected and transported to site. More preferably, the fluid separation equipment 140 is installed on the production tower 100 within its own frame structure after a portion of the production tower 100 is installed.

Optionally, additional subsea production operational equipment may be installed within the trussed frame 110 or proximate the second end 116 of the production tower 100. This is shown at Box 350 of FIG. 3B. The subsea production operational equipment may include, for example, (i) power generation equipment, (ii) pressure pumps, (iii) control valves, (iv) production manifold lines, or (v) combinations thereof. Alternately, the subsea production operational equipment can be installed a separate frame structure after a portion of the production tower is installed.

The method 300 may also comprise drilling a plurality of production wells. This is shown at Box 355. The wells are drilled through the seabed 54 and into a subsurface reservoir. Thereafter, the method 300 includes producing hydrocarbon fluids from the subsurface reservoir. This is provided at Box 360.

In connection with the drilling step of Box 355, the method 300 may further include placing a plurality of wellheads for each well on the production tower 100. Such wellheads are shown at 160 of FIG. 1. Each wellhead 160 receives production fluids from the subsurface reservoir through a surface casing that extends from the seabed and into the trussed frame. In this instance, the operational equipment comprises a production manifold. Alternatively, the method 300 includes placing a plurality of wellheads for each well on the seabed. Hydrocarbon fluids are then produced from the subsurface reservoir to the seabed, and then transported to the subsea production operational equipment within the production tower 100. The step of producing hydrocarbon fluids is shown at Box 360.

Regardless of the placement of the wellheads, production flowlines are installed for delivering production fluids from the respective wellheads to the subsea production operational equipment. The installation of flowlines is indicated at Box 365. Where the wellheads are placed in the production tower 100, production fluids may be directed through a production manifold.

The method 300 also includes installing a hydrocarbon transport line in the subsea production system. This is shown at Box 370 of FIG. 3B. The hydrocarbon transport line provides fluid communication between the subsea production operational equipment 140 and the one or more hydrocarbon fluids storage cells 130.

The method 300 further includes placing a first end of a production riser in fluid communication with the one or more hydrocarbon fluids storage cells. This is provided at Box 375. A second end of the production riser may be removably attached to a transport vessel at the surface. This is seen at Box 380. The transport vessel may be in accordance with vessel 180 of FIG. 1.

The method 300 also includes transferring hydrocarbon fluids from the one or more hydrocarbon fluids storage cells to the transport vessel. This is indicated at Box 385. The transport vessel may then carry the valuable hydrocarbon fluids to an offloading station for further refining and commercial distribution.

Figure 5:
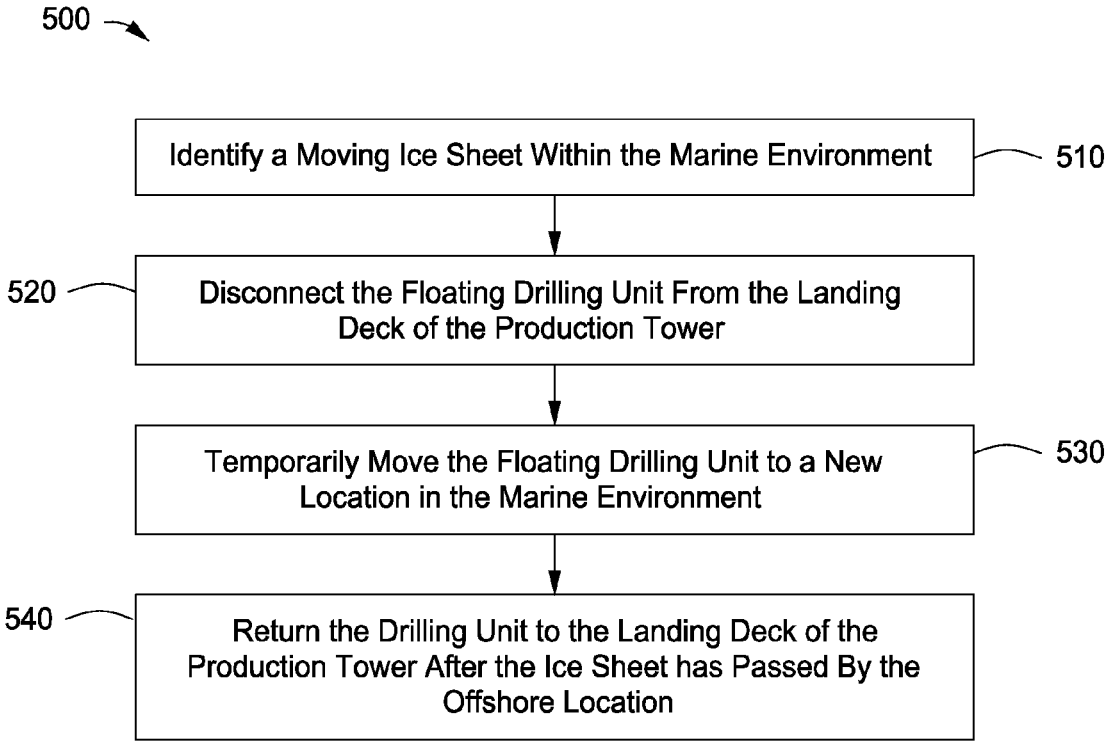
FIG. 5 is a flowchart showing steps for moving the floating drilling unit from the landing deck.

In some instances it is desirable to disconnect the drilling unit from the production tower 120. One such example is when an ice sheet is moving in the direction of the drilling unit. FIG. 5 provides a flowchart for a method 500 of relocating a drilling unit within a marine environment. The drilling unit may be in accordance with floating drilling unit 150 of FIG. 1.

The method 500 includes identifying a moving ice sheet within the marine environment. This is seen at Box 510. The identifying step of Box 510 may involve GPS monitoring or visual monitoring using an Arctic class ice-breaking vessel.

The method 500 also includes disconnecting the floating drilling unit from the production tower. This is shown at Box 520. The disconnecting step of Box 520 means lifting the drilling unit from the landing deck within the water. Note that the production tower mooring lines need not be disconnected, as they are not harnessed to the drilling unit itself, but to the underlying production tower. Likewise, the hydrocarbon transport line need not be disconnected, as it remains below the water surface connecting the subsea production operational equipment with the hydrocarbon fluids storage cells.

The method 500 further includes temporarily moving the drilling unit to a new location within the marine environment. This is provided at Box 530. The drilling unit preferably is not self-propelled; therefore, the moving step of Box 530 may involve the use of one or more work boats and working lines. The new location will, of course, be out of the line of approach by the ice sheet. In this way the floating structure is spared impact with the ice sheet.

In addition, the method 500 includes returning the drilling unit to the landing deck of the production tower after the ice sheet has passed by the offshore location. This is indicated at Box 540.

As can be seen, an improved subsea production system and related methods are offered. At least three key features are highlighted. First, the subsea production operational equipment is "co-located" or "integrated" into one location near the upper part of the production tower, below the water surface to avoid contact with ice. This arrangement provides benefits to the design of the equipment as the various vessels and equipment need only be designed to withstand water pressure at shallow water depths versus the deeper water depth requirement if placed on the seabed.

Second, placing all of the subsea production equipment within a single structural frame allows the option to pre-test the equipment before deployment and allows for installation within a short window of opportunity—critical in Arctic operations.

Third, use of a compliant tower allows for placement of a large, caisson-type drilling vessel directly onto the landing platform of the production tower. This provides a stable base for drilling operations and allows access to the subsea production operational equipment. Note that placement of such a large hydrodynamic mass on a structure is only feasible if the structure is compliant. Otherwise, the floating driller will impose enormous loads onto the structure, making its design infeasible, as is the case with the system described in '564.

The inventions described herein are not restricted to the specific embodiment disclosed herein, but are governed by the claims, which follow. While it will be apparent that the inventions herein described are well calculated to achieve the benefits and advantages set forth above, it will be appreciated that the inventions are susceptible to modification, variation and change without departing from the spirit thereof.

What is claimed is:

1. A subsea production system for conducting hydrocarbon recovery operations in a marine environment, the marine environment comprising a body of water having a surface and a seabed, and the production system comprising:

an elongated trussed frame having a first end and an opposing second end, the first end comprising a base residing proximate the seabed;

a landing deck at the second end of the trussed frame, the landing deck being configured to receive and releasably attach to a floating drilling unit, and the landing deck residing below the water surface a sufficient distance to avoid contact with a floating ice sheet;

one or more fluid storage cells residing at the seabed proximate the base of the trussed frame, at least one of the one or more fluid storage cells being a hydrocarbon fluids storage cell for receiving hydrocarbon fluids; and subsea production operational equipment residing above the seabed and proximate the second end of the trussed frame below the landing deck, the subsea production operational equipment being in fluid communication with the at least one hydrocarbon fluids storage cell.

2. The subsea production system of claim 1, wherein the subsea production operational equipment comprises (i) power generation equipment, (ii) pressure pumps, (iii) control valves, (iv) a production manifold, (v) fluid separation equipment or (vi) combinations thereof.

3. The subsea production system of claim 1, further comprising:

a hydrocarbon transport line providing fluid communication between the subsea production operational equipment and the at least one hydrocarbon fluids storage cell.

4. The subsea production system of claim 1, further comprising:

a plurality of wellheads disposed on the trussed frame, each wellhead receiving production fluids from a subsurface reservoir through a surface casing that extends from the seabed and into the trussed frame; and a production flowline for delivering production fluids from the wellhead to the subsea production operational equipment.

5. The subsea production system of claim 1, further comprising:

a production riser for transporting hydrocarbon fluids from the at least one hydrocarbon fluids storage cell to a transport vessel at the water surface, the production riser being in selective fluid communication with the transport vessel.

6. The subsea production system of claim 1, wherein:

the subsea production operational equipment receives production fluids from a plurality of wellheads located on the seabed; and the subsea production system further comprises production flowlines for transporting production fluids from the respective subsea wellheads to the subsea production operational equipment proximate the second end of the trussed frame.

7. The subsea production system of claim 1, wherein the trussed frame is generally frustum-shaped.

8. The subsea production system of claim 1, wherein the trussed frame has a substantially constant width between the first end and the second end.

9. The subsea production system of claim 1, further comprising:

a gravity base structure comprising the one or more fluid storage cells.

10. The subsea production system of claim 1, wherein the first end of the trussed frame comprises a gravity base.

11. The subsea production system of claim 1, further comprising:

a plurality of mooring lines circumscribing the production system, with each line having a first end connected to the trussed frame, and a second end connected to an anchor at the seabed.

12. The subsea production system of claim 11, wherein each of the anchors comprises a weighted block held on the seabed by gravity, or a frame structure with a plurality of pile-driven pillars or suction pillars secured to the seabed.

13. The subsea production system of claim 11, wherein the first end of each of the plurality of mooring lines is connected to the trussed frame proximate the second end of the trussed frame.

14. The subsea production system of claim 11, wherein each of the plurality of mooring lines is fabricated from chains, wire ropes, synthetic ropes, eyebars or pipes.

15. The subsea production system of claim 1, further comprising:

one or more buoyancy tanks within the trussed frame.

16. The subsea production system of claim 15, wherein the landing deck resides at least about 20 meters (66 feet) below the water surface.

17. The subsea production system of claim 1, wherein the trussed frame defines an articulated structure comprising:

a substantially rigid lower section extending upwardly from the seabed to a pivot point located intermediate the first end and the second end of the trussed frame; and a compliant upper section extending upwardly from the pivot point to the landing deck such that the compliant upper section is able to pivot relative to the substantially rigid lower section in response to wave energy and currents.

18. The subsea production system of claim 17, wherein the substantially rigid lower section comprises:

a plurality of pile sleeves attached to the trussed frame; and a plurality of piles passing through the pile sleeves to permit relative pivoting motion between the substantially rigid lower section and the compliant upper section.

19. The subsea production system of claim 18, wherein:

each of the plurality of pile sleeves is attached to the substantially rigid lower section; and each of the corresponding piles is attached to the compliant upper section.

20. The subsea production system of claim 18, wherein:

each of the plurality of pile sleeves is attached to the compliant upper section; and each of the corresponding piles is attached to the substantially rigid lower section.

21. The subsea production system of claim 18, wherein the substantially rigid lower section comprises a gravity base at the seabed.

22. The subsea production system of claim 1, wherein the drilling unit comprises:

a platform for conducting operations in the marine environment;

a tower configured to provide ballasting and stability below the water surface; and a base for attaching to the landing deck.

23. The subsea production system of claim 1, wherein the subsea production operational equipment includes fluid separation equipment.

24. The subsea production system of claim 23, wherein the fluid separation equipment is placed on the trussed frame proximate the second end.

25. The subsea production system of claim 23, wherein the fluid separation equipment is place on a separate frame structure positioned proximate the second end of the trussed frame.

26. A method for installing components for a subsea production system in a marine environment, the marine environment comprising a body of water having a surface and a seabed, and the method comprising:

identifying a location in the marine environment for hydrocarbon recovery operations;

placing one or more hydrocarbon fluids storage cells on the seabed at the selected location;

transporting an elongated trussed frame to the selected location, the trussed frame having a first end and an opposing second end;

installing the trussed frame in the marine environment such that the first end is placed on the seabed proximate the one or more hydrocarbon fluids storage cells;

transporting a frame structure containing the subsea production operational equipment;

installing the frame structure proximate to the second end of the trussed frame;

installing a landing deck proximate the second end of the trussed frame above the frame structure a distance below the water surface;

transporting a floating drilling unit to the selected location;

releasably attaching the floating drilling unit to the landing deck of the trussed frame;

connecting a hydrocarbon transport line so as to provide fluid communication between the subsea production operational equipment and the one or more hydrocarbon fluids storage cells.

27. The method of claim 26, wherein the subsea production operational equipment comprises (i) power generation equipment, (ii) pressure pumps, (iii) control valves, (iv) a production manifold, (v) fluid separation equipment or (vi) combinations thereof.

28. The method of claim 26, further comprising:

drilling a plurality of wells through the seabed and into a subsurface reservoir; and producing hydrocarbon fluids.

29. The method of claim 28, further comprising:

placing a plurality of wellheads for each well on the seabed; and installing production flowlines for delivering production fluids from the respective wellheads to the subsea production operational equipment.

30. The method of claim 28, further comprising:

placing a first end of a production riser in fluid communication with the one or more hydrocarbon fluids storage cells; and transferring hydrocarbon fluids from the one or more hydrocarbon fluids storage cells to a transport vessel.

31. The method of claim 28, further comprising:

placing a plurality of wellheads for each well on the trussed frame, each wellhead receiving production fluids from the subsurface reservoir through a surface casing that extends from the seabed and into the trussed frame; and installing production flowlines for delivering production fluids from the respective wellheads to the subsea production operational equipment.

32. The method of claim 31, wherein all production fluids received by the subsea production operational equipment flows through the plurality of wellheads disposed on the trussed frame.

33. The method of claim 26, further comprising:

lowering a plurality of anchors onto the seabed, the anchors circumscribing the trussed frame;

providing a corresponding plurality of mooring lines, each mooring line having a first end and a second end; and connecting the first end of each mooring line to an anchor at the seabed, and a second end of each mooring line to the trussed frame.

34. The method of claim 33, wherein each of the anchors comprises a weighted block held on the seabed by gravity, or a frame structure with a plurality of pile-driven pillars or suction pillars secured to the earth proximate the seabed.

35. The method of claim 26, wherein the trussed frame defines an articulated structure comprising:

a substantially rigid lower section extending upwardly from the seabed to a pivot point located intermediate the first and second ends of the trussed frame; and a compliant upper section extending upwardly from the pivot point towards the landing deck such that the compliant upper section is able to pivot laterally relative to the substantially rigid lower section in response to wave energy and currents.

36. The method of claim 26, further comprising:

attaching a floating drilling unit to the landing deck of the trussed frame.

37. The method of claim 26, further comprising:

identifying a moving ice sheet within the marine environment;

disconnecting the floating drilling unit from the landing deck of the trussed frame; and temporarily moving the floating drilling unit to a new location in the marine environment to avoid the moving ice sheet.

38. The method of claim 26, further comprising:

determining an anticipated maximum depth of moving ice sheets within the marine environment; and dimensioning the elongated trussed frame such that the landing deck is below the maximum depth when the trussed frame is erected.

39. The method of claim 38, wherein the landing deck resides at least 20 meters (66 feet) below the water surface.

40. A method of moving a floating drilling unit in a marine environment from an offshore location, the marine environment comprising a body of water having a surface and a seabed, and the method comprising:

identifying a moving ice sheet within the marine environment;

disconnecting the drilling unit from a subsea production tower, the subsea production tower comprising:

an elongated trussed frame having a first end and an opposing second end, the first end comprising a base residing proximate the seabed, a landing deck at the second end of the trussed frame, the landing deck being configured to receive and releasably attach to the drilling unit, and the landing deck residing at least 20 meters (66 feet) below the water surface, and subsea production operational equipment residing above the seabed and proximate the second end of the trussed frame below the landing deck, the subsea production operational equipment being in fluid communication with at least one hydrocarbon fluids storage cell on the seabed;

temporarily re-locating the drilling unit to a new location within the marine environment to avoid the moving ice sheet; and returning the drilling unit to the landing deck of the production tower after the ice sheet has passed by the offshore location.

41. The method of claim 40, wherein the subsea production operational equipment includes fluid separation equipment, the fluid separation equipment residing a distance below the landing deck within about 20% of the overall height of the subsea production tower.

* * * * *